US008172728B2

(12) United States Patent
Maresh et al.

(10) Patent No.: US 8,172,728 B2
(45) **Date of Patent: *May 8, 2012**

(54) ELLIPTICAL EXERCISE APPARATUS WITH FLEXIBLE UNITARY FORCE IMPARTING MEMBER

(76) Inventors: Joseph D. Maresh, West Linn, OR (US); Kenneth W. Stearns, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/706,700

(22) Filed: Feb. 16, 2010

(65) Prior Publication Data

US 2010/0323849 A1 Dec. 23, 2010

Related U.S. Application Data

(63) Continuation of application No. 11/981,667, filed on Oct. 30, 2007, now Pat. No. 7,662,069.

(60) Provisional application No. 60/855,284, filed on Oct. 30, 2006.

(51) Int. Cl.
*A63B 22/04* (2006.01)
*A63B 22/00* (2006.01)

(52) U.S. Cl. ..... 482/52; 482/51

(58) Field of Classification Search ..... 482/51–53, 482/57, 70, 79, 80

See application file for complete search history.

(56) References Cited

U.S. PATENT DOCUMENTS

| | | | | |
|---|---|---|---|---|
| 5,336,141 | A * | 8/1994 | Vittone | 482/51 |
| 5,643,148 | A * | 7/1997 | Naville | 482/77 |
| 6,019,709 | A * | 2/2000 | Piaget | 482/70 |
| 6,277,055 | B1 * | 8/2001 | Birrell et al. | 482/52 |
| 6,551,217 | B2 * | 4/2003 | Kaganovsky | 482/51 |
| 6,875,160 | B2 * | 4/2005 | Watterson et al. | 482/57 |
| 2001/0012811 | A1 * | 8/2001 | Gordon | 482/70 |

* cited by examiner

*Primary Examiner* — Stephen Crow
(74) *Attorney, Agent, or Firm* — Nick A Nichols, Jr.

(57) ABSTRACT

An exercise apparatus has a linkage assembly which links rotation of a crank to generally elliptical movement of a force receiving member. The linkage assembly includes a flexible drawbar interconnected between the crank and frame of the exercise apparatus.

12 Claims, 6 Drawing Sheets

ELLIPTICAL EXERCISE APPARATUS WITH FLEXIBLE UNITARY FORCE IMPARTING MEMBER

CROSS-REFERENCE TO RELATED APPLICATION

This application is a continuation application of U.S. patent application Ser. No. 11/981,677, filed Oct. 30, 2007, now U.S. Pat. No. 7,662,069, which claims the benefit of U.S. Provisional Application Ser. No. 60/855,284, filed Oct. 30, 2006, which application is incorporated herein by reference.

BACKGROUND OF THE INVENTION

The present invention relates to fitness apparatus, and in particular to fitness apparatus that constrain the user's foot to travel along an elliptical foot path.

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complex exercise motions to better simulate real life activity. Such equipment typically links a relatively simple motion, such as circular, to a relatively more complex motion, such as elliptical. Although advances have been made in this particular field, significant room for improvement remains, for example, with regard to the variability of exercise motion and/or the simplicity of design and improving overall safety.

SUMMARY OF THE INVENTION

In accordance with one embodiment, the elliptical exercise apparatus of the present invention links relatively simple, circular motion of a crank to relatively more complex, generally elliptical motion of a foot supporting member. More specifically, by introducing a flexible drawbar between the crank member and the frame, the present invention facilitates a variety of design options and/or exercise motion characteristics heretofore unavailable to the exercise equipment industry. The features and advantages of the present invention may become more apparent from the detailed description that follows.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Generally, the present invention provides exercise apparatus which link rotation of left and right cranks to generally elliptical motion of respective force receiving members. The term "elliptical motion" is intended in a broad sense to describe a closed path of motion having a relatively longer first axis and a relatively short second axis (which is perpendicular to the first axis). Although such motion and motion generating linkage assemblies are described with reference to a front end and rear end, those skilled in the art will recognize that the present invention is not limited to any particular orientation of the user.

All of the depicted embodiments of the present invention are generally symmetrical about a vertical plane extending lengthwise through a floor engaging base, the primary exception being the relative orientation of certain parts on opposite sides of the plane of symmetry. Typically, the "right-hand" parts are one hundred and eighty degrees out of phase relative to the "left-hand" counterparts. When reference is made to one or more parts on only one side of the apparatus, it is to be understood that corresponding part(s) are disposed on the opposite side of the apparatus. Those skilled in the art will also recognize that the portions of the frame which are intersected by the plane of symmetry exist individually and thus, do not have any "opposite-side" counterparts.

Figure 1:
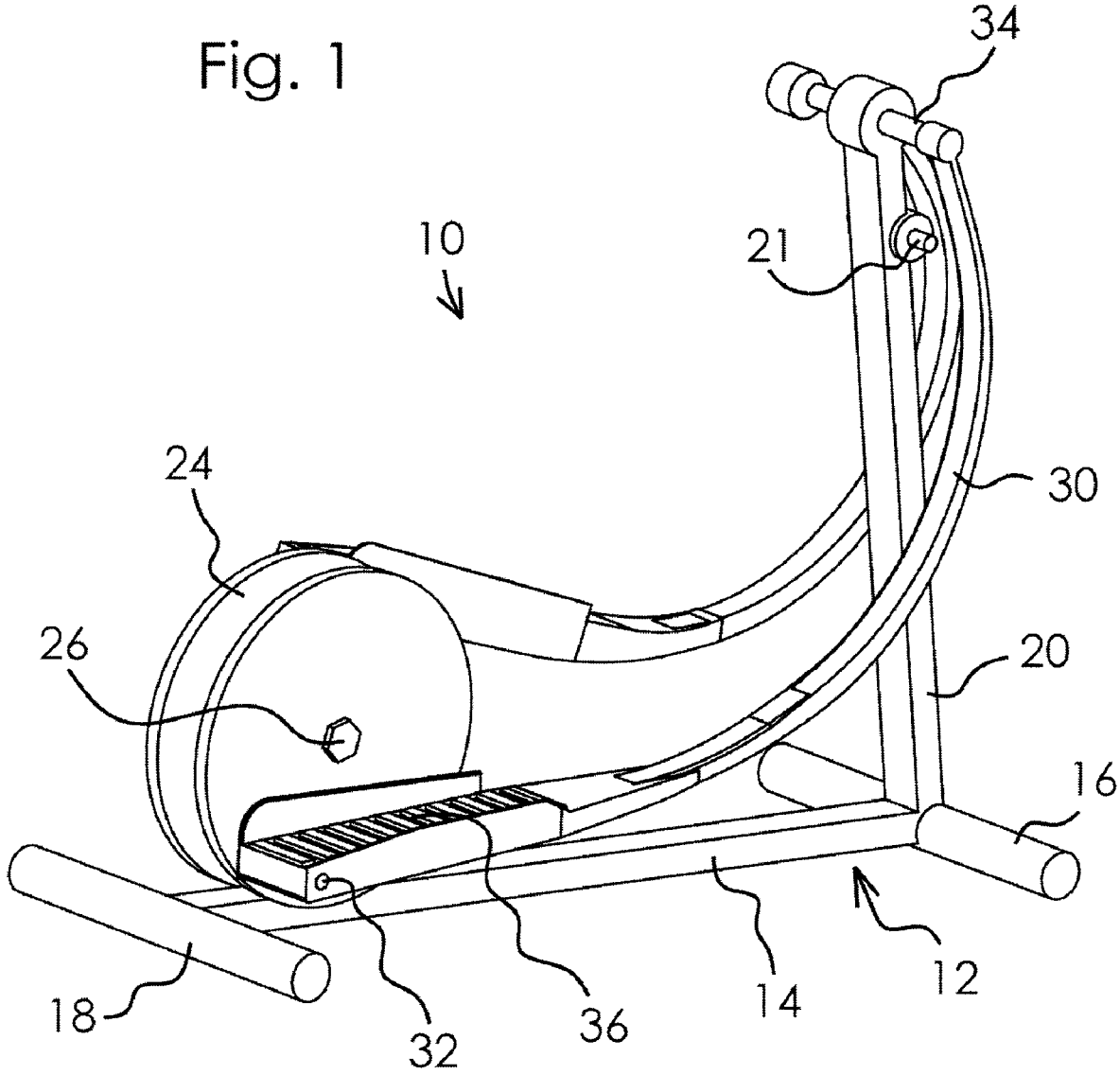
FIG. 1 is a perspective view of a first embodiment of the exercise apparatus of the present invention.
Figure 2:
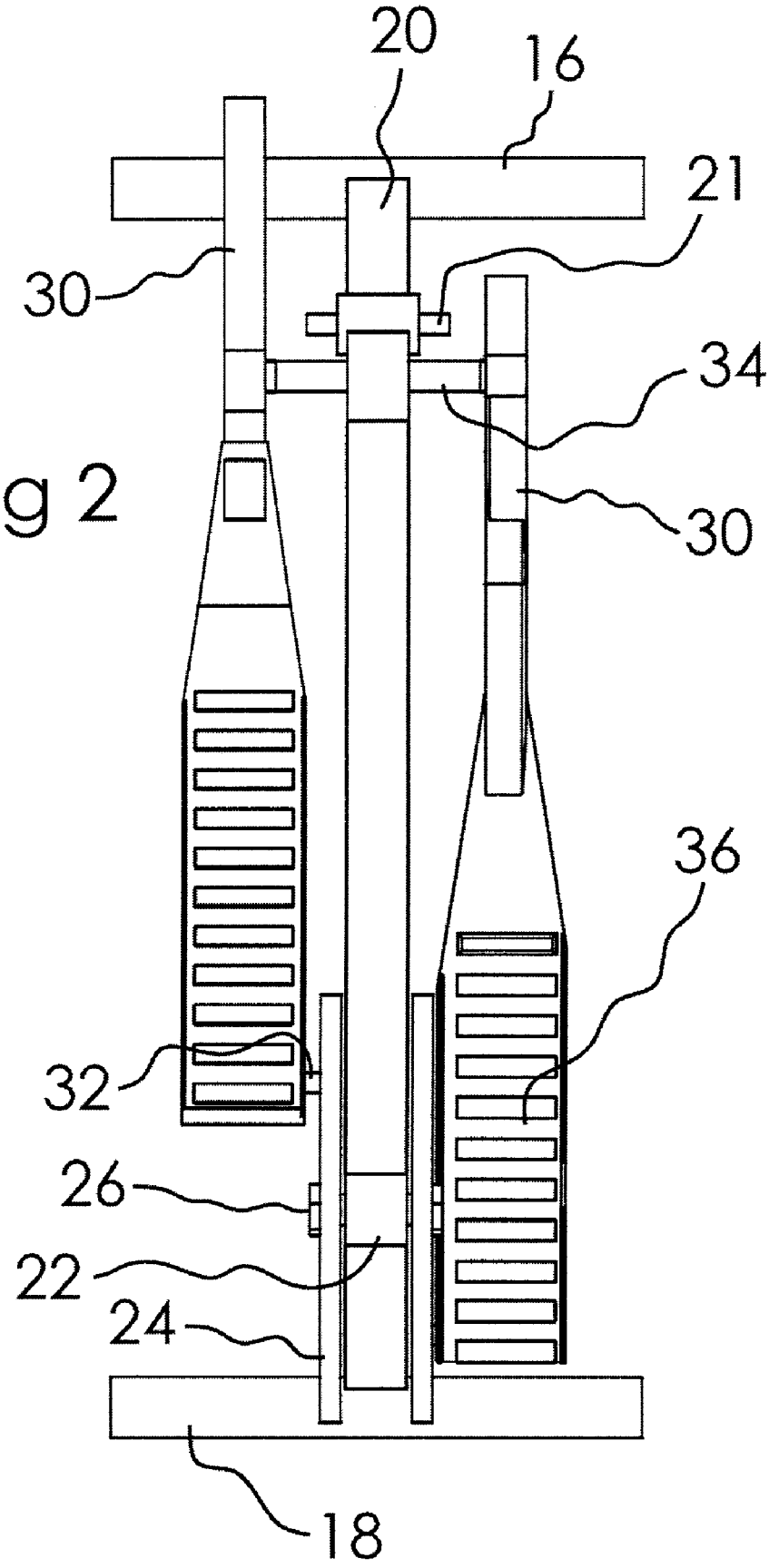
FIG. 2 is a top plan view of the exercise apparatus shown in FIG. 1.
Figure 3A:
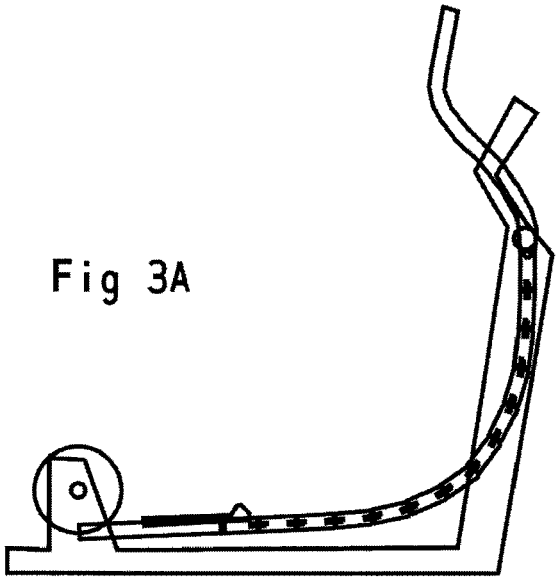
FIGS. 3A-3D illustrate motion simulation of the exercise apparatus shown in FIG. 1 at four distinct crank orientations.
Figure 3B:
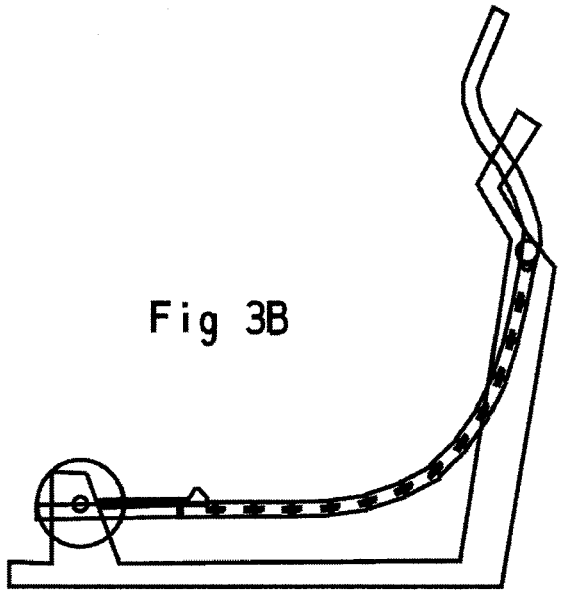
Figure 3C:
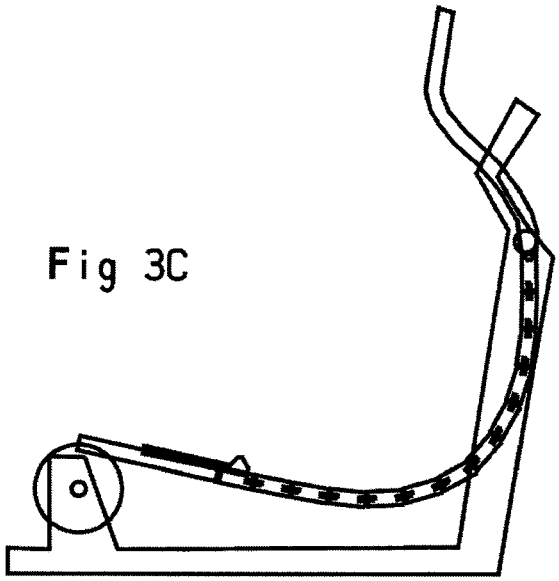
Figure 3D:
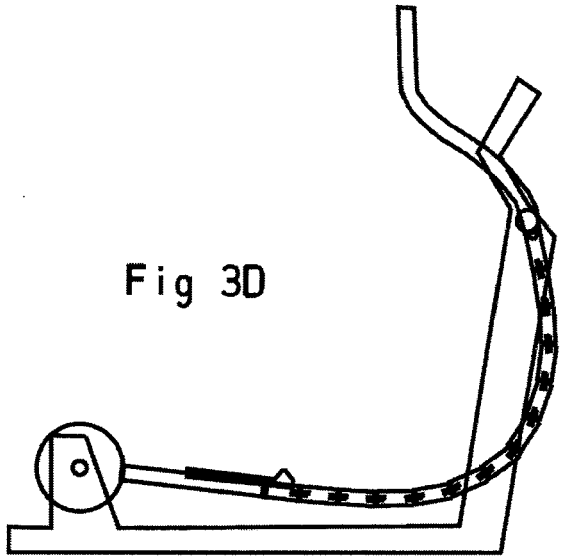

Referring first to FIG. 1, an exercise apparatus constructed in accordance with the present invention is generally identified by the reference numeral 10. The apparatus 10 includes a frame 12 having an I-shaped base 14 which extends from a first or forward end 16 to a second or rearward end 18 and is designed to rest upon a horizontal floor surface. A first stanchion or upright member 20 extends upward from the base 14 proximate the forward end 16. A second stanchion or upright member 22 extends upward from the base 14 proximate the rearward end 18.

On each side of the apparatus 10, a crank 24 is rotatably mounted to the rear stanchion 22 via a common pivot shaft 26. In particular, each crank 24 includes a respective flywheel which is rigidly secured to the crank shaft 26 and rotates together therewith relative to the frame 12. A drag strap (not shown in the drawings) may be disposed in tension about a circumferential groove on one or both flywheels to resist rotation thereof relative to the frame 12. Those skilled in the art will recognize that other forms of resistance means may be added to or substituted for the drag strap without departing from the scope of the present invention. Those skilled in the art will also recognize that the flywheels 24 may be described simply as members that rotate about the crank axis relative to the frame 12, and further, the flywheels 24 may be replaced by pulleys or crank arms, for example, which may or may not in turn be connected to a flywheel.

A drawbar 30 is mounted on each side of the frame 12. The rear end of the drawbar 30 is rotatably connected to a respective crank 24 at pivot axis 32. The forward end of the drawbar 30 is secured to a bearing shaft 34 rigidly mounted proximate the upper end of the stanchion 20. Handle bars may be rotatably secured proximate the upper end of the stanchion 20 at shaft 21. The handle bars may be indirectly connected to the drawbar 30 by links, bumpers or other intermediate connecting members.

The drawbar 30 includes a rear portion or foot platform 36 sized and configured to support a respective foot of a person standing thereon. The foot platform 36 is integral with the drawbar 30 of the apparatus 10 shown in FIG. 1. The foot platform 36 may be characterized as rigid or semi-flexible, however, the foot platform 36 is sufficiently rigid to support the weight of a person standing thereon and maintain a substantially horizontal orientation as it rotates about pivot shaft 26.

The unitary body of the drawbar 30 is tapered from the rear portion to the forward end thereof. That is the cross section perpendicular to the longitudinal axis of the drawbar 30 taken at its forward end is thinner than the rear portion thereof, as shown in FIG. 1. The forward portion of the drawbar 30 therefore has a greater degree of flexibility than the rear portion.

The unitary body of the drawbar 30 may be composed of a flexible material such as rubber, plastic, composite resin with fiberglass and/or carbon filaments or steel. Other materials, such as wood, may also be suitable, and/or any combination thereof. Furthermore, homogeneous and/or flexible laminated structures may also be suitable. A rubber drawbar 30, for example, may be molded in a shape which represents the median shape of the apparatus 10 while it is in operation. For an average size apparatus 10, with a respective crank 24 diameter of 18 inches, for example, the respective rear ends of the drawbar 30 move approximately +/−9 inches relative to each other (18 inches total). For these dimensions the shape of the parabolic bow formed by the drawbar 30 may have a dish depth of about 24 inches, as illustrated in the motion simulation sequence of FIGS. 3A-3D.

When considering metal, laminated leaf springs for example, and/or composite materials for the drawbar 30, the parabolic tapered design of the drawbar 30 of the present invention offers significant cost and/or weight reduction over a laminated leaf spring configuration. A parabolic tapered design for the drawbar 30 also minimizes inter-leaf friction and contact which also affects spring motion characteristics that may be calculated. For a linear spring constant for example, the resulting deflection beam theory for simple leaf springs yields $R=El/M$, where $D=(3PL^3)/(8Enbt^3)$ and: D=Deflection, P=Load, L=Length, E=Elastic Modulus, N=number of leafs, B=Width of leaf, and T=thickness.

The reaction force between the forward end of the drawbar 30 and the frame 12 of the apparatus 10 may be established at a relatively low numerical value. Typically, for a drawbar 30 in a relaxed profile representing the median shape of the drawbar 30 while the cranks 24 are, for example positioned at the 6 o'clock orientation depicted in FIG. 3A, the magnitude of the reaction force need not exceed several pounds when the cranks 24 are orientated at the 3 o'clock or 9 o'clock positions depicted in FIGS. 3B and 3D. The degree of cross section taper in this instance may be significantly reduced as the forward end of the drawbar 30 is approached while simultaneously the degree of flexibility may be greatly reduced toward the rearward end of the drawbar 30. Lateral stability of the foot platform 36 may be enhanced with ribs, protrusions, contours and the like which integrate with the rearward section of drawbar 30.

The single unitary body of the drawbar 30 permits the establishment of force and motion characteristics which are advantageous and new in the art. These motion characteristics pertain to the orientation of the foot platform 26, and how the toe rise and fall may generally be predetermined as a function of the design cross section of the flexible unitary body of the drawbar 30 at any given cross section along the length thereof. Generally, the body of the drawbar 30 is tapered to narrower dimensions as the cross section thereof approaches the forward upper end of the drawbar 30, as best shown in FIG. 1. Alternatively, the cross section of the flexible drawbar 30 may be minimized at any portion or section between the distal ends of drawbar 30. For example, it will be observed that the drawbar 30 depicted in FIG. 4, includes a section 40 where the cross section of the drawbar 30 has been tapered or minimized. Furthermore, the exact profile of the drawbar 30 may consist of sections that have constant cross section, all while allowing the occurrence of flex at generally preferred points or sections along the drawbar 30.

Figure 4:
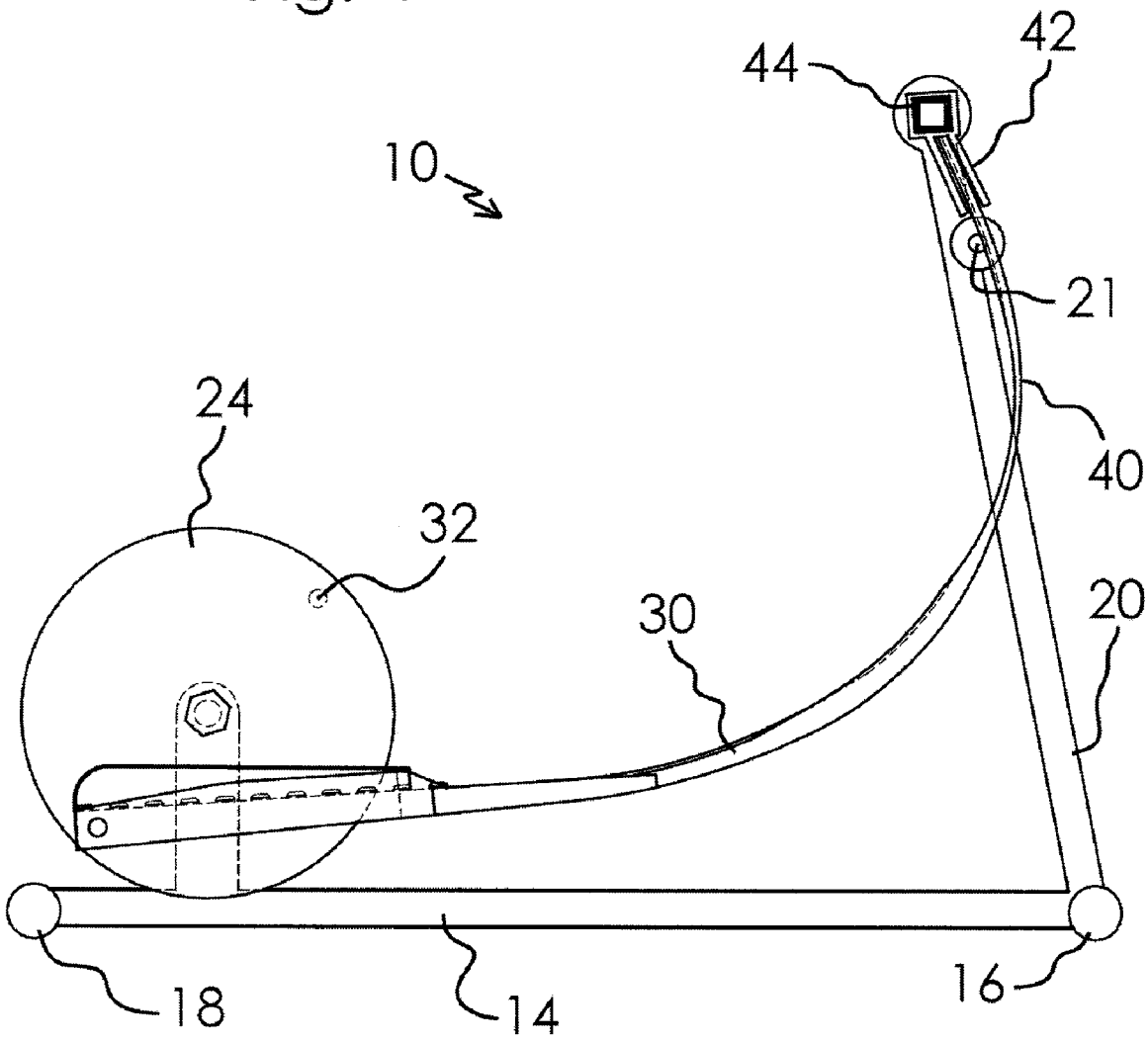
FIG. 4 is a side view of a second embodiment of the exercise apparatus of the present invention.

Referring still to FIG. 4, the upper end of the drawbar 30 is received within a sleeve 42 mounted on a bearing shaft 44 which is substantially square in cross section. The sleeve 42 is stationary and does not rotate about the bearing shaft 44, thus increasing the stiffness of the drawbar 30 at its upper forward end without changing the cross section of the drawbar 30 at that specific section of the drawbar 30. Sliding blocks (not shown in the drawings) may also be secured at various points on the drawbar 30 thereby changing the effective stiffness of the drawbar 30 in the area where the sliding blocks are secured. By adjusting the location of the sliding blocks on the drawbar 30, a user of the apparatus 10 may adjust the "feel" of heel rise and fall to suit his preference. In addition, "toe drop" phasing may be delayed or advanced as desired in order to arrive at a more natural "feel" for the user.

Figure 5:
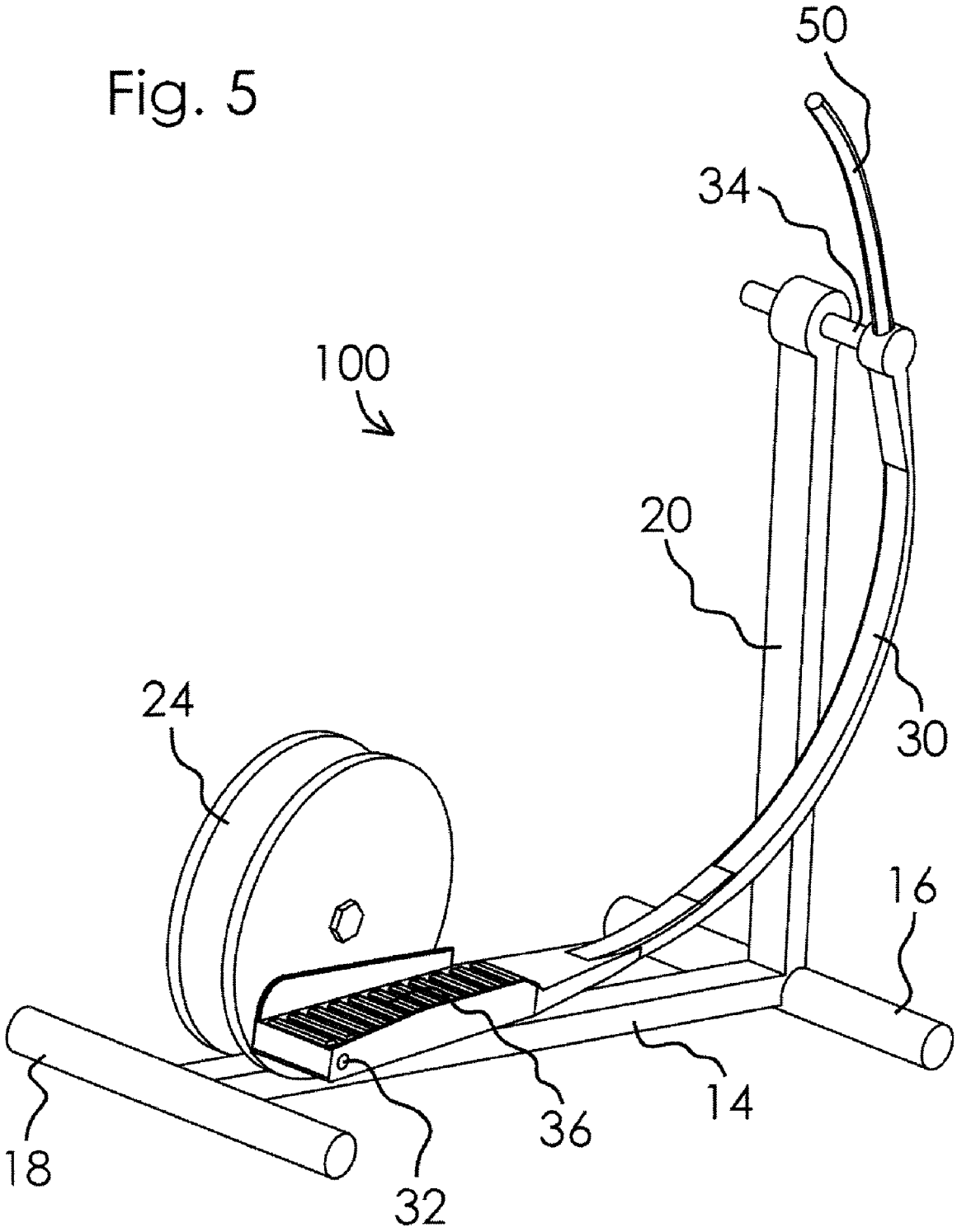
FIG. 5 is a perspective view of a third embodiment of the exercise apparatus of the present invention.

Referring now to FIG. 5, another embodiment of the apparatus of the present invention is generally identified by the reference numeral 100. The upper forward end of the drawbar 30 terminates in a protrusion or hand grip 50. In this embodiment, the rigidity of the drawbar 30 section in the vicinity of the bearing shaft 34 is such that the user's hand moves in an opposite direction to the user's foot. The drawbar 30 is thus in direct contact with both the user's hand and the user's foot at respective one side of the user's body. Handle bars may be secured to the frame 12 which interact in a direct, or in a connecting indirect manner as indicated above, with the drawbar 30, further allowing the user to make dynamic changes to the motion of the connected foot platform 36. In this instance, for a given orientation of the crank 24, for example, if the user pulls back on, pushes forward or holds the hand grip 50 stationary, the foot platform 36 may rise or fall and re-orientate in response to the changing stiffness of the drawbar 30.

Figure 6:
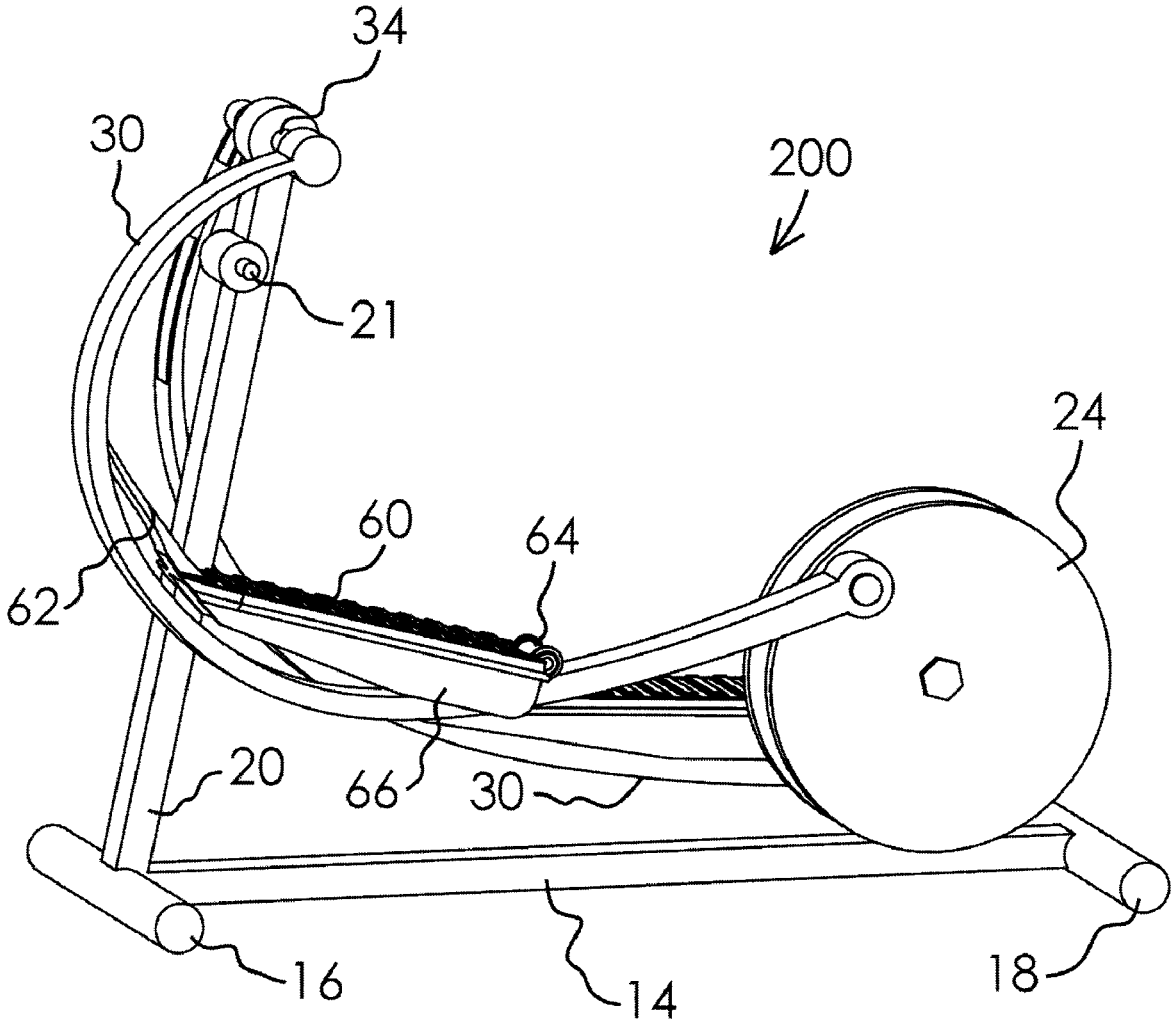
FIG. 6 is a perspective view of a fourth embodiment of the exercise apparatus of the present invention.

Referring now to FIG. 6, another embodiment of the apparatus of the present invention is generally identified by the reference numeral 200. In the embodiment of FIG. 6, a foot platform 60 rides on the drawbar 30. The forward end of the foot platform 60 is connected to the drawbar 30 by a tether 62, such as tape, cords, wire, pins and the like. An optional roller 64 is secured to the rear end of the foot platform 60 allowing relative longitudinal motion between the foot platform 60 and the drawbar 30 as the drawbar 30 flexes. In the absence of a roller 64, the rear end of the foot platform 60 is free to slide on the drawbar 30. Downwardly extending side members 66 provide lateral restraint and prevent the foot platform 60 from disengaging the drawbar 30.

As noted above, the user may make dynamic changes to the motion of the connected foot platform. Remote control electric and/or mechanical actuators may be utilized such as solenoids, servo motors, and/or hydraulic and/or pneumatic components, or other suitable means, without departing from the spirit and scope of the invention. Furthermore, a user interface device may be mounted at the console, and a switch provided within reach of a user of the exercise apparatus of the present invention applying force against the handle bar. The user may make the exercise strokes longer or shorter simply by pushing a button or switch. Those skilled in the art will recognize that the switch could be replaced by other suitable means, including a knob, for example, which not only rotates to make adjustments but also cooperates with indicia on the device to indicate the current level of adjustment.

While a preferred embodiment of the invention has been shown and described, other and further embodiments of the invention may be devised without departing from the basic scope thereof, and the scope thereof is determined by the claims which follow.

The invention claimed is:

1. An exercise apparatus, comprising:

a) a frame designed to rest upon a floor surface;

b) a left crank and a right crank, wherein each said crank is mounted on said frame and rotatable relative thereto about a common crank axis;

c) a left leg support member and a right leg support member, wherein each said leg support member includes a proximal end connected to said frame and a distal end pivotally connected to one of a respective crank; and d) wherein each said leg support member defines a parabolic shape between said proximal and distal ends, and wherein each said leg support member defines an elongate flexible body wherein the cross section dimension of said body increases along the longitudinal length of said body.

2. The exercise apparatus of claim 1, wherein said distal end of each said leg support member is sized and configured to accommodate a user's foot.

3. The exercise apparatus of claim 1, including a first foot support member and a second foot support member, wherein each said foot support member includes a first end connected to a respective leg support member and a second end rollably supported by a respective leg support member.

4. The exercise apparatus of claim 1, wherein each said leg support member have respective upper ends sized and configured for grasping.

5. The exercise apparatus of claim 1, including a first foot support member and a second foot support member, wherein each said foot support member includes a first end connected to a respective leg support member and a second end slideably supported by a respective leg support member.

6. The exercise apparatus of claim 1 wherein the minimum cross section dimension of each said leg support member is proximate said proximal end of each said leg support and the maximum cross section dimension of each said leg member is proximate said distal end of each said leg support.

7. The exercise apparatus of claim 1 including a left and right sleeve fixed to said frame, each said sleeve sized and configured to receive said proximal end of a respective leg support.

8. The exercise apparatus of claim 1 wherein said proximal end of each said leg support terminates in a hand grip providing simultaneous direct contact of each said leg support with a user's hand and foot.

9. An exercise apparatus, comprising:

a) a frame designed to rest upon a floor surface;

b) a left crank and a right crank, wherein each said crank is mounted on said frame and rotatable relative thereto about a common crank axis;

c) a left drawbar and a right drawbar, wherein each said drawbar includes a proximal end connected to said frame and rotatable about a common pivot axis and a distal end pivotally connected to one of a respective crank, and wherein each said drawbar defines an elongate flexible body wherein the cross section dimension of said body increases along the longitudinal length of said body; and d) wherein each said drawbar includes an intermediate portion extending between said proximal end and said distal end, and wherein each said intermediate portion defines a parabolic shape.

10. The apparatus of claim 9, wherein said distal end of each said drawbar is sized and configured to accommodate a user's foot.

11. The exercise apparatus of claim 9 wherein the minimum cross section dimension of each said drawbar is located along an intermediate portion between said proximal and distal ends of said leg support.

12. An exercise apparatus, comprising:

a) a frame designed to rest upon a floor surface;

b) a left crank and a right crank, wherein each said crank is mounted on said frame and rotatable relative thereto about a common crank axis;

c) a left flexible member and a right flexible member, wherein each said flexible member includes a first portion connected to said frame and rotatable about a common pivot axis and a second portion pivotally connected to one of a respective crank; and d) including a first foot support member and a second foot support member, wherein each said foot support member include a first portion connected to a respective flexible member and a second portion rollably supported by said respective flexible member.

* * * * *